US006655922B1

(12) United States Patent
Flek

(10) Patent No.: US 6,655,922 B1
(45) Date of Patent: Dec. 2, 2003

(54) SYSTEM AND METHOD FOR DETECTING AND DIAGNOSING PUMP CAVITATION

(75) Inventor: Ondrej Flek, Lodenice (CZ)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 12 days.

(21) Appl. No.: 09/927,969

(22) Filed: Aug. 10, 2001

(51) Int. Cl.[7] ..... F04B 49/00

(52) U.S. Cl. ..... 417/44.1; 417/44.2; 417/43; 706/904; 706/906; 73/1.35; 73/1.37

(58) Field of Search ..... 417/44.1, 53, 63, 417/473.1, 44.2, 43; 706/903, 904, 906; 415/17, 30, 47, 914; 73/1.35, 1.37, 31.04, 170.14

(56) References Cited

U.S. PATENT DOCUMENTS

| | | | | | |
|---|---|---|---|---|---|
| 4,119,016 | A | | 10/1978 | Pfeil et al. | 91/449 |
| 4,278,051 | A | * | 7/1981 | Shida | 122/406.2 |
| 4,399,663 | A | | 8/1983 | Hesler | 62/193 |
| 4,512,722 | A | * | 4/1985 | Mouton | 417/63 |
| 4,650,633 | A | * | 3/1987 | Youngborg | 376/210 |
| 4,856,284 | A | * | 8/1989 | Mattiola et al. | 62/50.7 |
| 4,881,374 | A | | 11/1989 | Mattiola et al. | 62/50.6 |
| 4,881,375 | A | | 11/1989 | Mattiola et al. | 62/50.6 |
| 4,909,076 | A | * | 3/1990 | Busch et al. | 73/168 |
| 5,235,524 | A | * | 8/1993 | Barkhoudarian | 702/39 |
| 5,284,523 | A | * | 2/1994 | Badami et al. | 134/18 |
| 5,332,356 | A | | 7/1994 | Gulich | 415/118 |
| 5,861,560 | A | * | 1/1999 | Harvey | 73/861.18 |
| 6,145,332 | A | | 11/2000 | Hyde | 62/190 |
| 6,260,004 | B1 | | 7/2001 | Hays et al. | 702/183 |
| 6,330,525 | B1 | * | 12/2001 | Hays et al. | 702/183 |
| 6,487,903 | B2 | * | 12/2002 | Sabini et al. | 73/168 |
| 2002/0123856 | A1 | * | 9/2002 | Eryurek | 702/140 |
| 2002/0152807 | A1 | * | 10/2002 | Sabini et al. | 73/168 |

FOREIGN PATENT DOCUMENTS

| | | | | |
|---|---|---|---|---|
| EP | 19858946 | | 12/1998 | |
| JP | 57179796 A | * | 11/1982 | G21C/17/00 |
| JP | 63030787 A | * | 2/1988 | G21C/15/24 |
| JP | 01273898 A | * | 11/1989 | |

* cited by examiner

*Primary Examiner*—Timothy Thrope
*Assistant Examiner*—Emmanuel Sayoc
(74) *Attorney, Agent, or Firm*—Amin & Turocy, LLP; Alexander M. Gerasimow; William R. Walbrun

(57) ABSTRACT

The present invention provides cavitation detection systems and methods employing a classifier for detecting, diagnosing and/or classifying cavitation in a pumping system. The classifier can be integral to tie cavitation detection system and/or operatively coupled to the cavitation system via a controller, diagnostic device and/or computer. Parameters such as flow, pressure and motor speed arc measured and/or estimated, and then provided to a classifier system Such systems include Bayesian, Fuzzy Set, nonlinear regression, neural networks and other training systems, for example The classifier system provides a signal indicative of the existence and extent of cavitation. An exemplary classification system is presented that delineates cavitation extent into one or more of the following categories: 0 (no cavitation), 1 (incipient cavitation), 2 (medium cavitation), 3 (fill cavitation) and 4 (surging cavitation). The cavitation signal can be utilized for monitoring and/or controlling a pumping system to mitigate pump wear, failure and other conditions associated with cavitation.

34 Claims, 8 Drawing Sheets

SYSTEM AND METHOD FOR DETECTING AND DIAGNOSING PUMP CAVITATION

TECHNICAL FIELD

The present invention relates to the art of pumping systems, and more particularly to systems and methodologies for detecting and diagnosing pump cavitation.

BACKGROUND OF THE INVENTION

Motorized pumps are employed in industry for controlling fluid flowing in a pipe, fluid level in a tank or container, or in other applications, wherein the pump receives fluid via an intake and provides fluid to an outlet at a different (e.g., higher) pressure and/or flow rate. Such pumps may thus be employed to provide outlet fluid at a desired pressure (e.g., pounds per square inch or PSI), flow rate (e.g., gallons per minute or GPM), or according to some other desired parameter associated with the performance of a system in which the pump is employed. For example, the pump may be operatively associated with a pump control system implemented via a programmable logic controller (PLC) or other type of controller coupled to a motor drive, which controls the pump motor speed in order to achieve a desired outlet fluid flow rate, and which includes I/O circuitry such as analog to digital (A/D) converters for interfacing with sensors and outputs for interfacing with actuators associated with the controlled pumping system. In such a configuration, the control algorithm in the PLC may receive process variable signals from one or more sensors associated with the pump, such as a flow meter in the outlet fluid stream, inlet (suction) pressure sensors, outlet (discharge) pressure sensors, and the like, and may make appropriate adjustments in the pump motor speed such that the desired flow rate is realized.

In conventional motorized pump control systems, the motor speed is related to the measured process variable by a control scheme or algorithm, for example, where the measured flow rate is compared with the desired flow rate (e.g., setpoint). If the measured flow rate is less than the desired or setpoint flow rate, the PLC may determine a new speed and send this new speed setpoint to the drive in the form of an analog or digital signal. The drive may then increase the motor speed to the new speed setpoint, whereby the flow rate is increased. Similarly, if the measured flow rate exceeds the desired flow rate, the motor speed may be decreased. Control logic within the control system may perform the comparison of the desired process value (e.g., flow rate setpoint) with the measured flow rate value (e.g., obtained from a flow sensor signal and converted to a digital value via a typical A/D converter), and provide a control output value, such as a desired motor speed signal, to the motor drive according to the comparison.

The control output value in this regard, may be determined according to a control algorithm, such as a proportional, integral, derivative (PID) algorithm, which provides for stable control of the pump in a given process. The motor drive thereafter provides appropriate electrical power, for example, three phase AC motor currents, to the pump motor in order to achieve the desired motor speed to effectuate the desired flow rate in the controlled process. Load fluctuations or power fluctuations which may cause the motor speed to drift from the desired, target speed are accommodated by logic internal to the drive. The motor speed is maintained in this speed-control manner based on drive logic and sensed or computed motor speed.

Motorized pump systems, however, are sometimes subjected to process disturbances, which disrupt the closed loop performance of the system. In addition, one or more components of the process may fail or become temporarily inoperative, such as when partial or complete blockage of an inlet or outlet pipe occurs, when a pipe breaks, when a coupling fails, or when a valve upstream of the pump fluid inlet or downstream of the pump discharge fluid outlet becomes frozen in a closed position. In certain cases, the form and/or nature of such disturbances or failures may prevent the motorized pump from achieving the desired process performance. For instance, where the pump cannot supply enough pressure to realize the desired outlet fluid flow rate, the control system may increase the pump motor speed to its maximum value. Where the inability of the pump to achieve such pressure is due to inadequate inlet fluid supply, partially or fully blocked outlet passage, or some other condition, the excessive speed of the pump motor may cause damage to the pump, the motor, or other system components.

Some typical process disturbance conditions associated with motorized pump systems include pump cavitation, partial or complete blockage of the inlet and/or outlet, and impeller wear or damage. Cavitation is the formation of vapor bubbles in the inlet flow regime or the suction zone of the pump, which can cause accelerated wear, and mechanical damage to pump seals, bearing and other pump components, mechanical couplings, gear trains, and motor components. This condition occurs when local pressure drops to below the vapor pressure of the liquid being pumped. These vapor bubbles collapse or implode when they enter a higher-pressure zone (e.g., at the discharge section or a higher pressure area near the impeller) of the pump, causing erosion of impeller casings as well as accelerated wear or damage to other pump components.

If a motorized pump runs for an extended period under cavitation conditions, permanent damage may occur to the pump structure and accelerated wear and deterioration of pump internal surfaces, bearings, and seals may occur. If left unchecked, this deterioration can result in pump failure, leakage of flammable or toxic fluids, or destruction of other machines or processes for example. These conditions may represent an environmental hazard and a risk to humans in the area. Thus, it is desirable to provide improved control and/or diagnostic systems for motorized pumps, which minimize or reduce the damage or wear associated with pump cavitation and other process disturbances, failures, and/or faults associated with motorized pump systems and pumping processes.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Rather, the sole purpose of this summary is to present some concepts of the invention in a simplified form as a prelude to the more detailed description that is presented hereinafter. The invention provides methods and systems for detecting cavitation in pumping systems. The methods comprise measuring pressure and flow information related to the pumping system and detecting cavitation using a classifier system, such as a neural network. The systems comprise a classifier system for detecting pump cavitation according to flow and pressure data. The invention may be employed in cavitation monitoring, as well as in control equipment associated with pumping systems, whereby pump wear and failure associated with cavitation conditions may be reduced or mitigated.

One aspect of the invention provides a system for detecting cavitation in a motorized pumping system, comprising a classifier system for detecting pump cavitation according to flow and pressure data. The classifier system may comprise a neural network receiving flow and pressure signals from flow and pressure sensors associated with the pumping system, wherein the neural network is trained using back propagation. The classifier may further receive pump speed data from a speed sensor associated with the pumping system to detect pump cavitation according to the flow, pressure, and speed data. In this manner, pump cavitation may be detected for pumping systems employing variable frequency motor drives. The neural network of the classifier system may be further adapted to determine the extent of cavitation in the pumping system, such as by providing an output according to the degree of cavitation in the pump. The neural network, moreover, may provide a cavitation signal indicative of the existence and extent of cavitation in the pumping system, wherein the cavitation signal may be used to change the operation of the pumping system according to the extent of cavitation.

According to another aspect of the present invention, there is provided a method of detecting cavitation in a pumping system having a motorized pump, comprising measuring pump flow and pressure data, and detecting pump cavitation according to the flow and pressure data using a classifier system. The classifier system may comprise a neural network trained by back propagation, which inputs pressure and flow information and outputs a classification of the existence and the extent of cavitation in the pumping system. Pump speed may also be measured and provided to the neural network, whereby pump cavitation may be detected and diagnosed at different pump speeds. The methodology may further comprise providing a cavitation signal indicative of the extent of cavitation, and changing or altering the operation of the pumping system in accordance therewith, whereby the system may be controlled to reduce or mitigate pump cavitation.

To the accomplishment of the foregoing and related ends, the invention, then, comprises the features hereinafter fully described. The following description and the annexed drawings set forth in detail certain illustrative aspects of the invention. However, these aspects are indicative of but a few of the various ways in which the principles of the invention may be employed. Other aspects, advantages and novel features of the invention will become apparent from the following detailed description of the invention when considered in conjunction with the drawings.

DETAILED DESCRIPTION OF THE INVENTION

Figure 1:
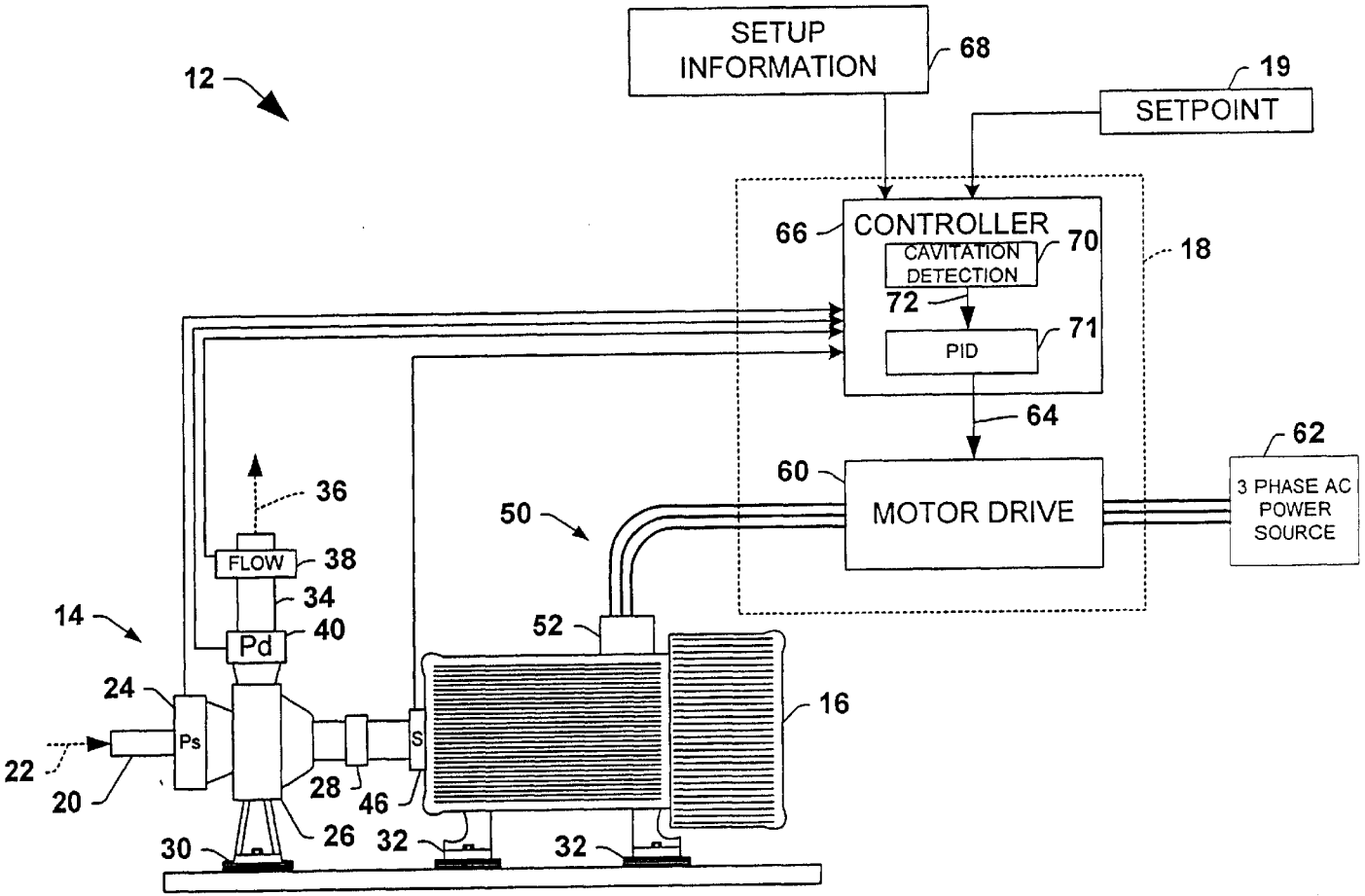
FIG. 1 is a side elevation view illustrating an exemplary motorized pump system and a cavitation detection system therefor in accordance with an aspect of the present invention.

The various aspects of the present invention will now be described with reference to the drawings, wherein like reference numerals are used to refer to like elements throughout. The invention provides systems and methods by which the adverse effects of pump cavitation may be reduced or mitigated by measuring pressure and flow information associated with a pumping system and detecting cavitation using a classifier system, such as a neural network trained via back propagation, receiving the pressure and flow information as inputs to the classifier. The classifier system may further consider pump speed information in detecting cavitation, whereby cavitation may be diagnosed at different pump speeds.

Figure 2:
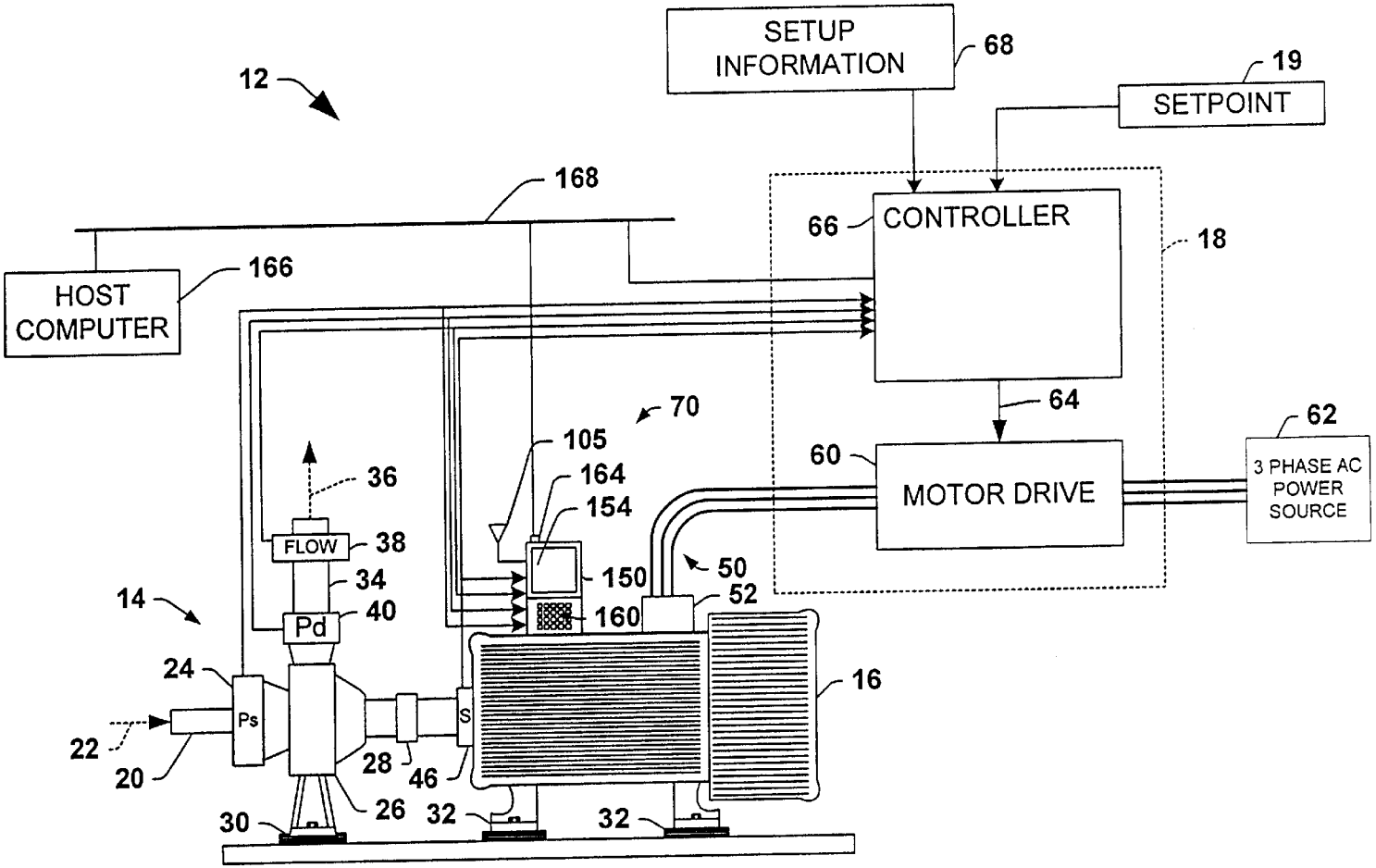
FIG. 2 is a side elevation view illustrating another exemplary motorized pump system and a cavitation detection system therefor in accordance with the invention.
Figure 3:
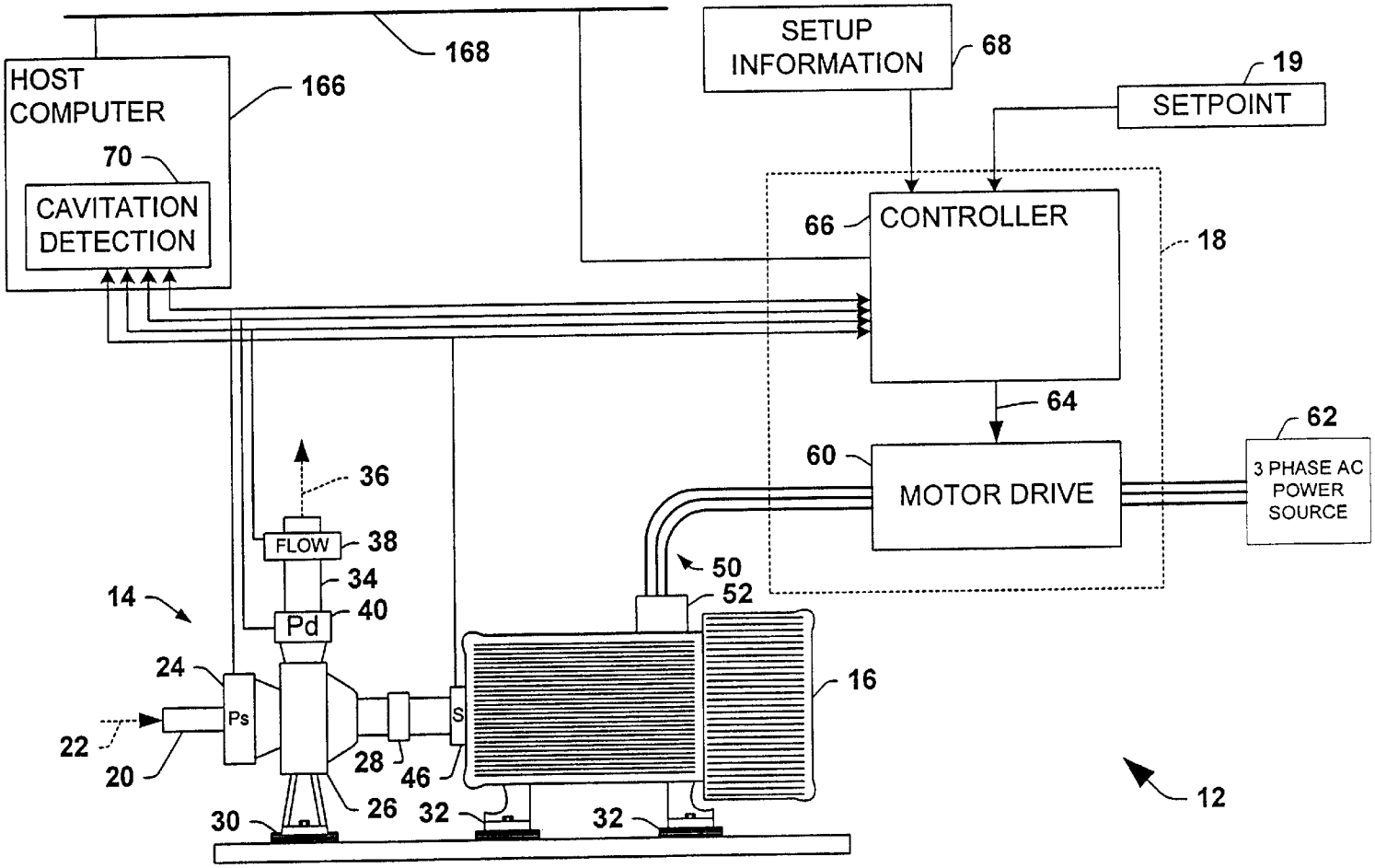
FIG. 3 is a side elevation view illustrating another exemplary motorized pump system and a cavitation detection system therefor in accordance with the invention.

Referring now to FIGS. 1–3, an aspect of the present invention involves systems and apparatus for pump cavitation detection and/or diagnosis. The cavitation detection system may be operatively associated with a pumping system, and may be located in a controller, a stand-alone diagnostic device, or in a host computer, as illustrated and described in greater detail hereinafter with respect to FIGS. 1, 2, and 3, respectively. An exemplary motorized pumping system 12 is illustrated in FIG. 1 having a pump 14, a three phase electric motor 16, and a control system 18 for operating the system 12 in accordance with a setpoint 19. Although the exemplary motor 16 is illustrated and described herein as a polyphase asynchronous electric motor, the various aspects of the present invention may be employed in association with single phase motors as well as with DC and other types of motors. In addition, the pump 14 may comprise a centrifugal type pump, however, the invention finds application in association with other pump types not illustrated herein, for example, positive displacement pumps. The control system 18 operates the pump 14 via the motor 16 according to the setpoint 19 and one or more measured process variables, in order to maintain operation of the system 12 commensurate with the setpoint 19 and within the allowable process operating ranges specified in setup information 68. For example, it may be desired to provide a constant fluid flow, wherein the value of the setpoint 19 is a desired flow rate in gallons per minute (GPM) or other engineering units.

The pump 14 comprises an inlet opening 20 through which fluid is provided to the pump 14 in the direction of arrow 22 as well as a suction pressure sensor 24, which senses the inlet or suction pressure at the inlet 20 and provides a corresponding suction pressure signal to the control system 18. Fluid is provided from the inlet 20 to an impeller housing 26 including an impeller (not shown), which rotates together with a rotary pump shaft coupled to the motor 16 via a coupling 28. The impeller housing 26 and the motor 16 are mounted in a fixed relationship with respect to one another via a pump mount 30, and motor mounts 32. The impeller with appropriate fin geometry rotates within the housing 26 so as to create a pressure differential between the inlet 20 and an outlet 34 of the pump. This causes fluid from the inlet 20 to flow out of the pump 14 via the outlet or discharge tube 34 in the direction of arrow 36. The flow rate of fluid through the outlet 34 is measured by a flow sensor 38, which provides a flow rate signal to the control system 18.

In addition, the discharge or outlet pressure is measured by a pressure sensor 40, which is operatively associated with the outlet 34 and provides a discharge pressure signal to the control system 18. It will be noted at this point that although one or more sensors (e.g., suction pressure sensor 24, discharge pressure sensor 40, outlet flow sensor 38, and others) are illustrated in the exemplary system 12 as being associated with and/or proximate to the pump 14, that such sensors may be located remote from the pump 14, and may be associated with other components in a process or system (not shown) in which the pump system 12 is employed. Alternatively, flow may be approximated rather than measured by utilizing pressure differential information, pump speed, fluid properties, and pump geometry information or a pump model. Alternatively or in combination, inlet and/or discharge pressure values may be estimated according to other sensor signals and pump/process information.

In addition, it will be appreciated that while the motor drive 60 is illustrated in the control system 18 as separate from the motor 16 and from the controller 66, that some or all of these components may be integrated. Thus, for example, an integrated, intelligent motor may include the motor 16, the motor drive 60 and the controller 66. Furthermore, the motor 16 and the pump 14 may be integrated into a single unit (e.g., having a common shaft wherein no coupling 28 is required), with or without integral control system (e.g., control system 18, comprising the motor drive 60 and the controller 66) in accordance with the invention.

The control system 18 further receives process variable measurement signals relating to motor (pump) rotational speed via a speed sensor 46. As illustrated and described further hereinafter, a cavitation detection system 70 within the controller 66 may advantageously detect and/or diagnose cavitation in the pump 14 using a neural network classifier receiving suction and discharge pressure signals from sensors 24 and 40, respectively, as well as flow and pump speed signals from the flow and speed sensors 38 and 46. The motor 16 provides rotation of the impeller of the pump 14 according to three-phase alternating current (AC) electrical power provided from the control system via power cables 50 and a junction box 52 on the housing of the motor 16. The power to the pump 14 may be determined by measuring the current provided to the motor 16 and computing pump power based on current, speed, and motor model information. This may be measured and computed by a power sensor (not shown), which provides a signal related thereto to the control system 18. Alternatively or in combination, the motor drive 60 may provide motor torque information to the controller 66 where pump input power is calculated according to the torque and possibly speed information.

The control system 18 also comprises a motor drive 60 providing three-phase electric power from an AC power source 62 to the motor 16 via the cables 50 in a controlled fashion (e.g., at a controlled frequency and amplitude) in accordance with a control signal 64 from the controller 66. The controller 66 receives the process variable measurement signals from the suction pressure sensor 24, the discharge pressure sensor 40, the flow sensor 38, and the speed sensor 46, together with the setpoint 19, and provides the control signal 64 to the motor drive 60 in order to operate the pump system 12 commensurate with the setpoint 19. In this regard, the controller 66 may be adapted to control the system 12 to maintain a desired fluid flow rate, outlet pressure, motor (pump) speed, torque, suction pressure, or other performance characteristic. Setup information 68 may be provided to the controller 66, which may include operating limits (e.g., min/max speeds, min/max flows, min/max pump power levels, min/max pressures allowed, NPSHR values, and the like), such as are appropriate for a given pump 14, motor 16, and piping and process conditions.

The controller 66 comprises a cavitation detection system 70, which is adapted to detect and/or diagnose cavitation in the pump 14, according to an aspect of the invention. Furthermore, the controller 66 selectively provides the control signal 64 to the motor drive 60 via a PID control component 71 according to the setpoint 19 (e.g., in order to maintain or regulate a desired flow rate) and/or a cavitation signal 72 from the cavitation detection component 70 according to detected cavitation in the pump, whereby operation of the pumping system 12 may be changed or modified according to the cavitation signal 72. The cavitation detection system 70 may detect the existence of cavitation in the pump 14, and additionally diagnose the extent of such cavitation according to pressure and flow data from the sensors 24, 40, and 38 (e.g., and pump speed data from the sensor 46), whereby the cavitation signal 72 is indicative of the existence and extent of cavitation in pump 14.

Referring also to FIG. 2, the cavitation detection system 70 may comprise a stand-alone diagnostic device 150. The diagnostic component or device 150 is operatively associated with the motor 16 and the pump 14, in order to receive pressure, flow, and pump speed signals from the sensors 24, 40, 38, and 46, whereby pressure and flow (e.g., and pump speed) information is provided to a classifier (e.g., neural network) in the cavitation detection system 70, as illustrated and described hereinafter with respect to FIGS. 4–7. In addition, the diagnostic component 150 may include a display 154 for displaying information to an operator relating to the operation of the motorized pumping system 12. The diagnostic component 150 may further include an operator input device 160 in the form of a keypad, which enables a user to enter data, information, function commands, etc. For example, the user may input information relating to system status via the keypad 160 for subsequent transmission to a host computer 166 via a network 168. In this regard, the control system 18 may also be operatively connected to the network 168 for exchanging information with the diagnostic component 150 and/or the host computer 166, whereby cavitation signals or cavitation information from the cavitation detection system 70 may be provided to one or both of the controller 66 and/or the host computer 166. In addition, the keypad 160 may include up and down cursor keys for controlling a cursor, which may be rendered on the display 154. Alternatively or in addition, the diagnostic component 150 may include a tri-state LED (not shown) without the display 154 or the keypad 160. Alternatively, the diagnostic component 150 could be integrated into the motor 16 and/or the pump 14.

The diagnostic component 150 may further include a communications port 164 for interfacing the diagnostic component 150 with the host computer 166 via a conventional communications link, such as via the network 168 and/or a wireless transmitter/receiver 105. According to an aspect of the present invention, the diagnostic component 150 may be part of a communication system including a network backbone 168. The network backbone 168 may be a hardwired data communication path made of twisted pair cable, shielded coaxial cable or fiber optic cable, for example, or may be wireless or partially wireless in nature (e.g., via transceiver 105). Information is transmitted via the network backbone 168 between the diagnostic component 150 and the host computer 166 (e.g., and/or the control system 18) which are coupled to the network backbone 168. The communication link may support a communications standard, such as the RS232C standard for communicating command and parameter information. However, it will be appreciated that any communication link or network link such as DeviceNet suitable for carrying out the present invention may be employed.

Referring as well to FIG. 3, the cavitation detection system 70 may reside in the host computer 166, for example, wherein the cavitation detection system 70 is implemented in whole or in part in software executing in the host computer 166. In this regard, it will be appreciated that the cavitation detection system 70 may receive pressure and flow information or data from the sensors 24, 40, and 38 (e.g., as well as speed information from sensor 46) via a data acquisition board in the host computer 166 and/or via communications from the controller 66 via the network 168, in order to perform detection and/or diagnosis of cavitation in the pumping system 12.

Figure 4:
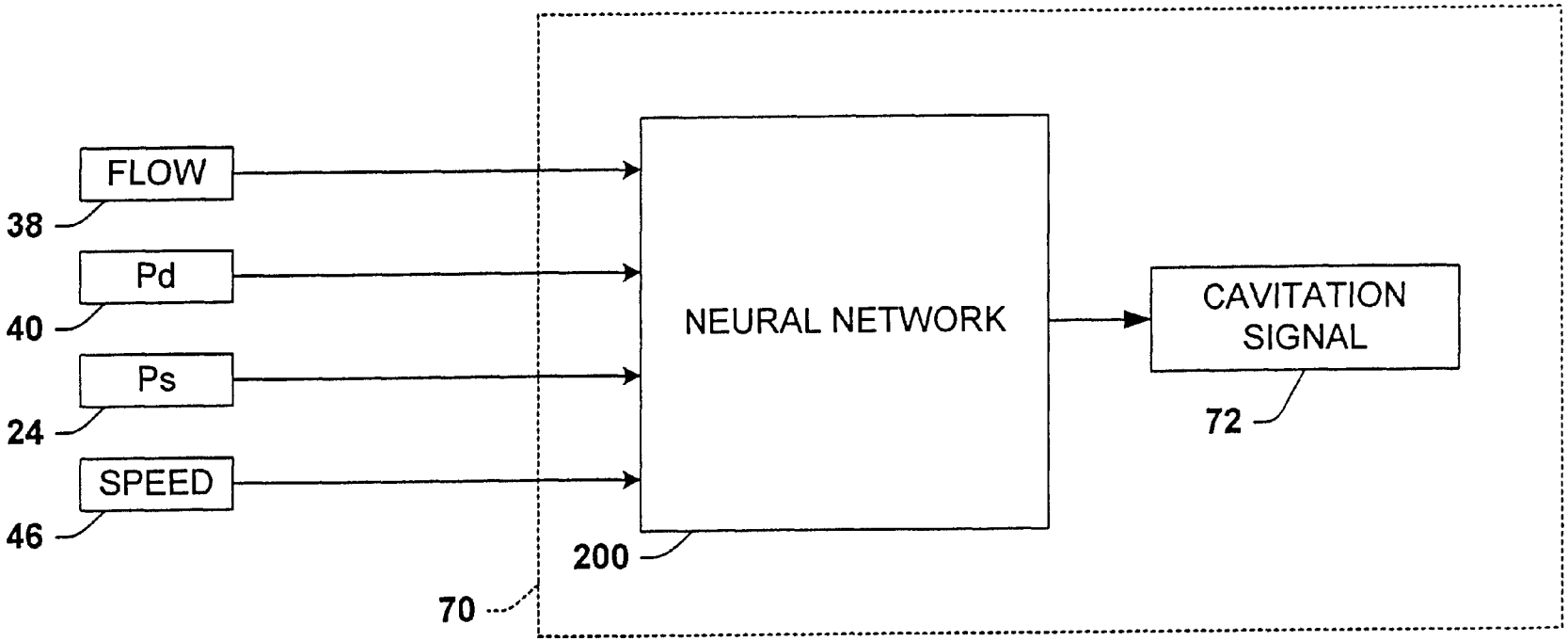
FIG. 4 is a schematic diagram illustrated further aspects of the exemplary cavitation detection system in accordance with the invention.
Figure 5:
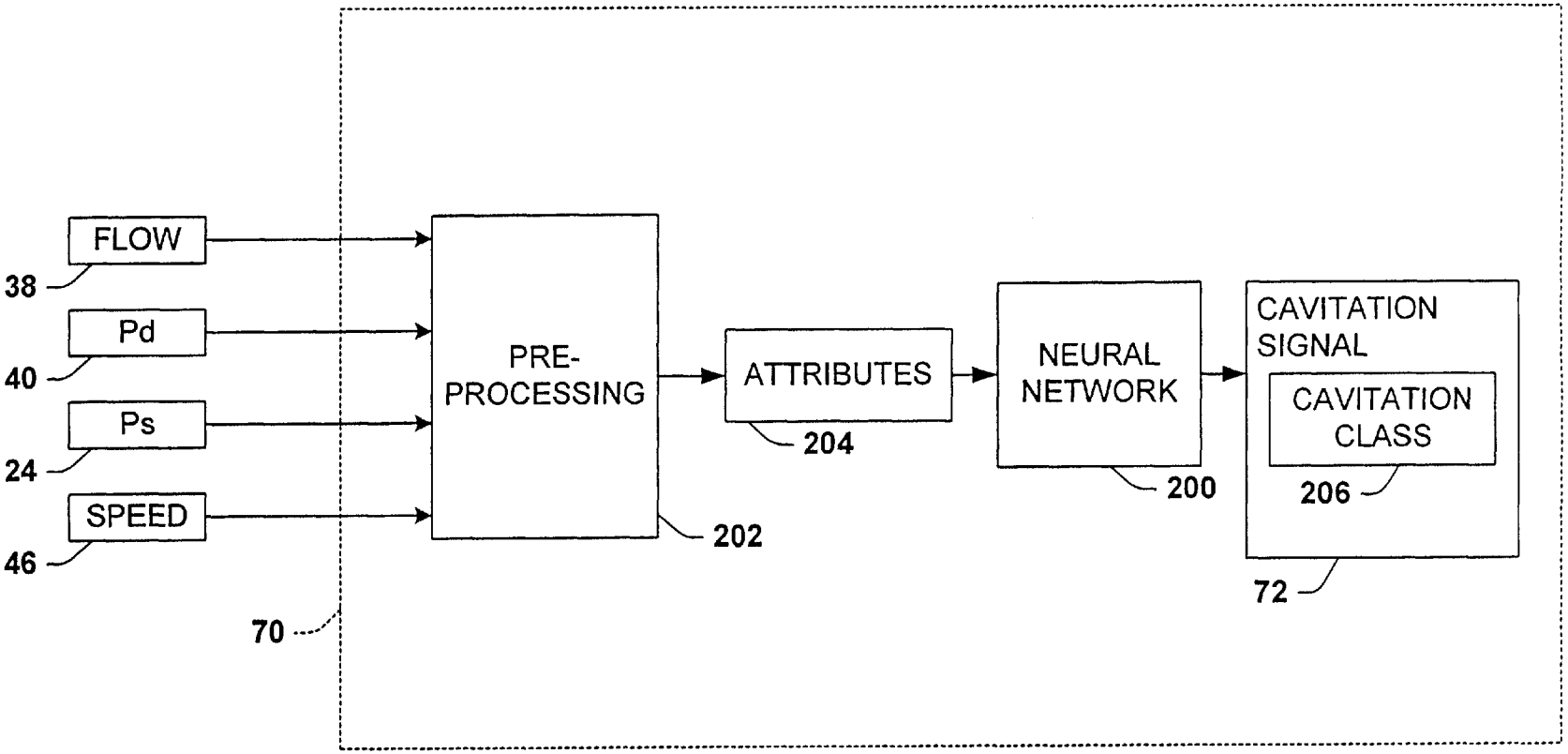
FIG. 5 is a schematic diagram further illustrating the exemplary cavitation detection system of FIG. 4.

Referring also to FIGS. 4 and 5, the cavitation detection system 70 according to the invention may comprise a classifier system such as a neural network 200 for detecting pump cavitation according to flow and pressure data. The classifier neural network 200 receives flow and pressure signals from flow and pressure sensors 38, 40, and 24 associated with the pumping system 12 of FIGS. 1–3, which are then used as inputs to the neural network 200. The network 200 processes the pressure and flow information or data and outputs a cavitation signal 72, which indicates the existence of cavitation. In addition, the signal 72 may classify the extent of cavitation in the pump 14. The neural network 200 may, but need not, receive motor (pump) speed information from the speed sensor 46, which may also be used in detecting and diagnosing the existence and extent of cavitation in the pumping system 12. For example, the speed information from the sensor 46 may be employed by the neural network 200 in order to facilitate or improve the detection and/or diagnosis of pump cavitation where the pump 14 is driven at different speeds (e.g., via a variable frequency motor drive 60). It will be appreciated that while the exemplary implementations of the present invention are primarily described in the context of employing a neural network, the invention may employ other nonlinear training systems and/or methodologies (e.g., for example, back-propagation, Bayesian, Fuzzy Set, nonlinear regression, or other neural network paradigms including mixture of experts, cerebellar model arithmetic computer (CMACS), radial basis functions, directed search networks, and functional link nets).

Referring also to FIG. 5, the cavitation detection system 70 may further comprise a pre-processing component 202 receiving the pressure and flow data from the sensors 24, 40, and 38, respectively, which provides one or more attributes 204 to the neural network 200, wherein the attributes 204 may represent information relevant to cavitation which may be extracted from the measured pressure, flow, and/or speed values associated with the pumping system 12. The attributes 204 may thus be used to characterize pump cavitation by the neural network 200. The neural network 200, in turn, generates a cavitation signal 72 which may comprise a cavitation classification 206 according to another aspect of the invention. The neural network classifier 200 thus evaluates data measured in the diagnosed pumping system 12 (e.g., represented by the attributes 204) and produces a diagnosis (e.g., cavitation signal 72) assessing the presence and severity of cavitation in the system 12. The neural network in this regard, may employ one or more algorithms, such as a multi-layer perception (MLP) algorithm in assessing pump cavitation.

Figure 6:
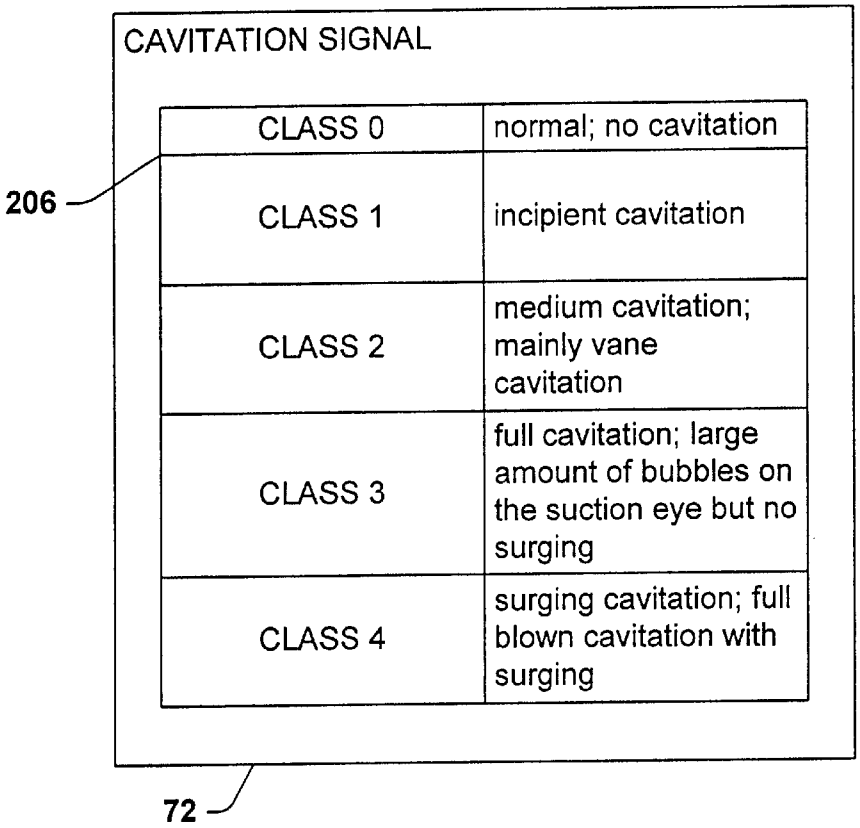
FIG. 6 is a schematic diagram illustrating an exemplary cavitation classification in accordance with the invention.

As illustrated further in FIG. 6, the cavitation signal 72 output by the classifier neural network 200 is indicative of both the existence and the extent of cavitation in the pumping system 12. For instance, the exemplary signal 72 comprises a classification 206 of pump cavitation having one of a plurality of class values, such as 0, 1, 2, 3, and 4. In the exemplary classification 206 of FIG. 6, each of the class values is indicative of the extent of cavitation in the pumping system 12, wherein class 0 indicates that no cavitation exists in the pumping system 12. The invention thus provides for detection of the existence of cavitation (e.g., via the indication of class values of 1 through 4 in the cavitation signal 72), as well as for diagnosis of the extent of such detected cavitation, via the employment of the neural network classifier 200 in the cavitation detection system 70. It will be noted at this point that the cavitation classification 206 is but one example of a classification possible in accordance with the present invention, and that other such classifications, apart from those specifically illustrated and described herein, are deemed as falling within the scope of the present invention.

Figure 7:
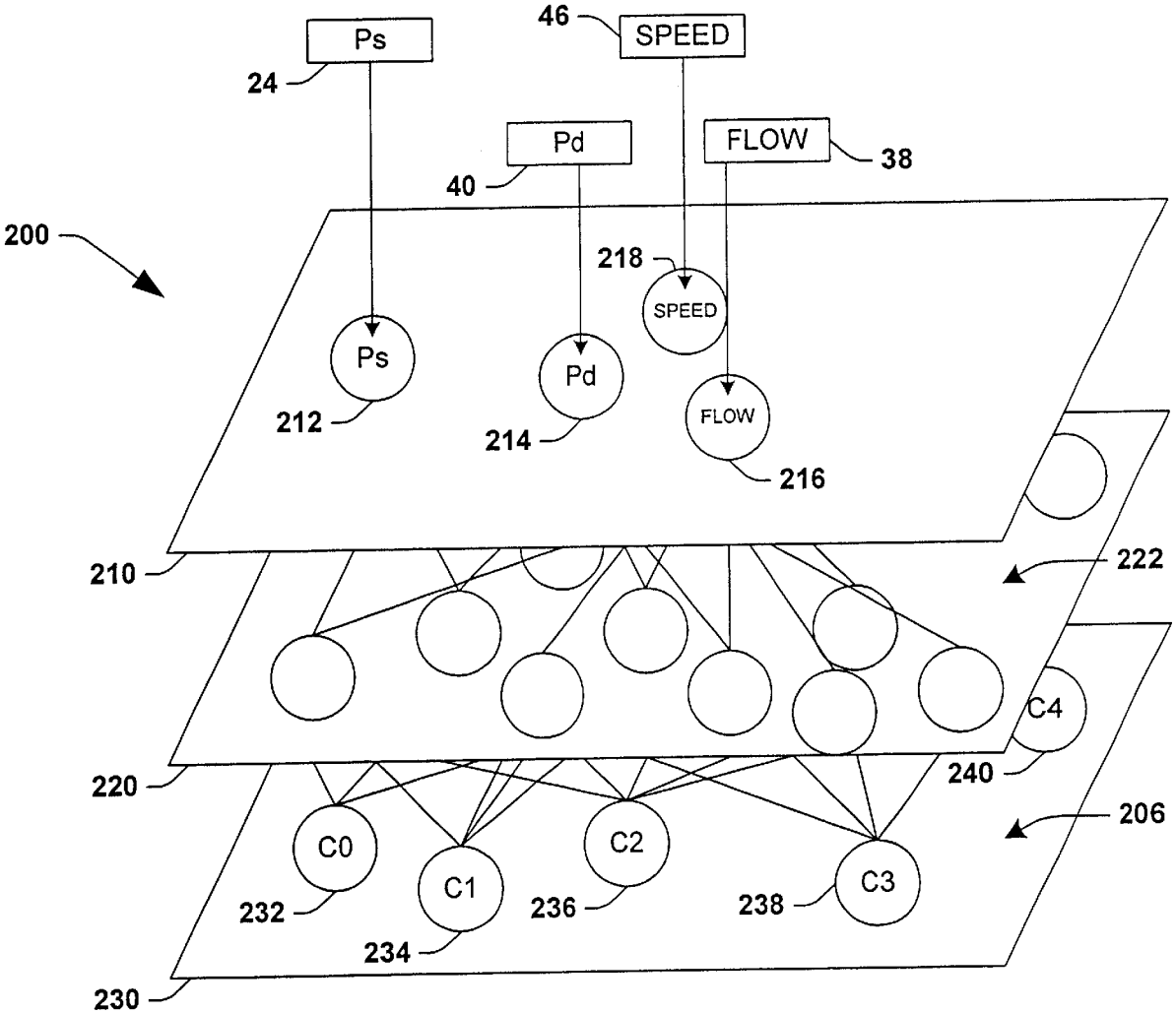
FIG. 7 is a perspective schematic diagram illustrating an exemplary neural network in accordance with another aspect of the invention.

Referring now to FIG. 7, the exemplary neural network 200 comprises an input layer 210 having neurons 212, 214, 216, and 218 corresponding to the suction pressure, discharge pressure, flow rate, and pump speed signals, respectively, received from the sensors 24, 40, 38, and 46 of the pumping system 12. One or more intermediate or hidden layers 220 are provided in the network 200, wherein any number of hidden layer neurons 222 may be provided therein. The neural network 200 further comprises an output layer 230 having a plurality of output neurons corresponding to the exemplary cavitation classification values of the class 206 illustrated and described hereinabove with respect to FIG. 6. Thus, for example, the output layer 230 may comprise output neurons 232, 234, 236, 238, and 240 corresponding to the class values 0, 1, 2, 3 and 4, respectively, whereby the neural network 200 may output a cavitation signal (e.g., signal 72) indicative of the existence as well as the extent of cavitation in the pumping system (e.g., system 12) with which it is associated.

In this regard, the number, type, and configuration of the neurons in the hidden layer(s) 220 may be determined according to design principles known in the art for establishing neural networks. For instance, the number of neurons in the input and output layers 210 and 230, respectively, may be selected according to the number of attributes (e.g., pressures, flow, speed, etc.) associated with the system 70, and the number of cavitation classes 206. In addition, the number of layers, the number of component neurons thereof, the types of connections among neurons for different layers as well as among neurons within a layer, the manner in which neurons in the network 200 receive inputs and produce outputs, as well as the connection strengths between neurons may be determined according to a given application (e.g., pumping system) or according to other design considerations.

Accordingly, the invention contemplates neural networks having many hierarchical structures including those illustrated with respect to the exemplary network 200 of FIG. 7, as well as others not illustrated, such as resonance structures. In addition, the inter-layer connections of the network 200 may comprise fully connected, partially connected, feed-forward, bi-directional, recurrent, and off-center or off surround interconnections. The exemplary neural network 200, moreover, may be trained according to a variety of techniques, including but not limited to back propagation, unsupervised learning, and reinforcement learning, wherein the learning may be performed on-line and/or off-line. For instance, where transitions between classes are continuous and differences between classes of cavitation are slight, it may be difficult to use unsupervised learning for the purpose of cavitation detection, in which case supervised learning may be preferred, which may advantageously employ back propagation. In this regard, training of the classifier may be done on a sufficient amount of training data covering many cavitation degrees (e.g., severities) and operating conditions of the pumping system. Furthermore, the training of the network 200 may be accomplished according to any appropriate training laws or rules, including but not limited to Hebb's Rule, Hopfield Law, Delta Rule, Kohonen's Learning Law, and/or the like, in accordance with the present invention.

Figure 8:
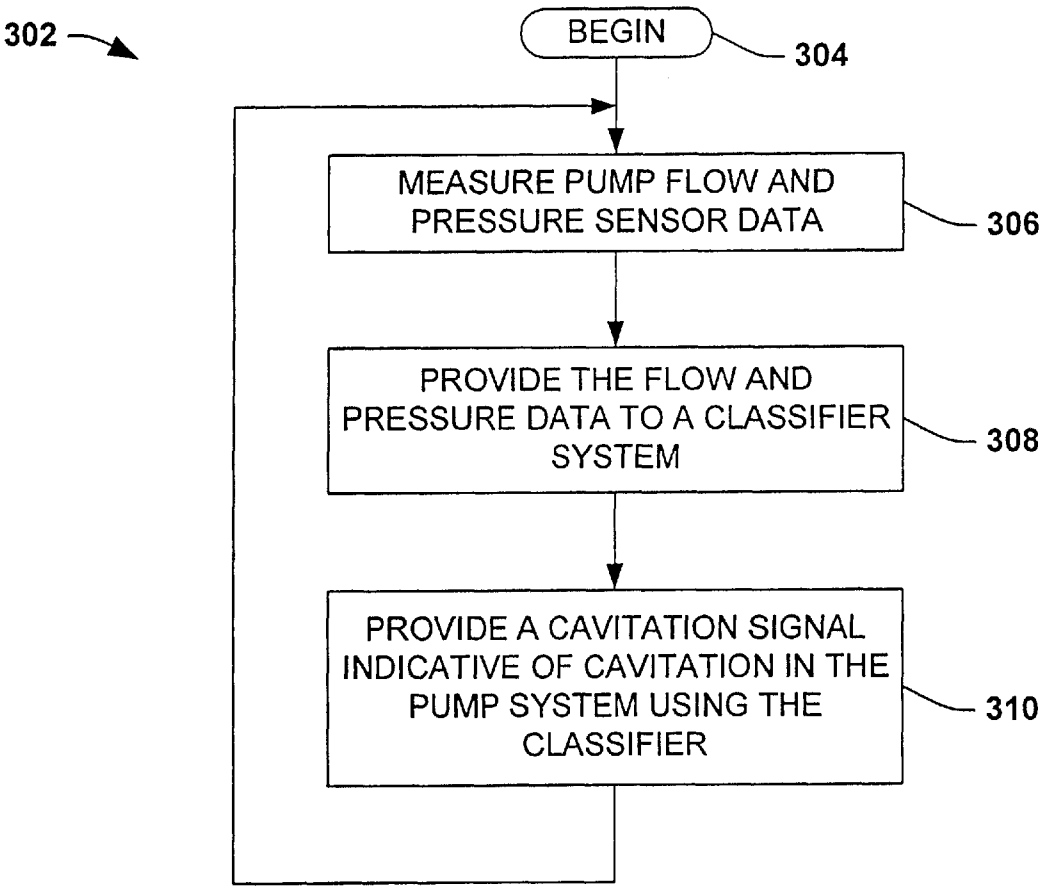
FIG. 8 is a flow diagram illustrating an exemplary method of detecting cavitation in a pumping system in accordance with an aspect of the present invention.

An exemplary method 302 of detecting cavitation in a pumping system is illustrated in FIG. 8 in accordance with another aspect of the present invention. The various methodologies of the invention may comprise measuring pump flow and pressure data, providing the flow and pressure data to a classifier system, and detecting pump cavitation according to the flow and pressure data using the classifier system. While the exemplary method 302 is illustrated and described herein as a series of blocks representative of various events and/or acts, the present invention is not limited by the illustrated ordering of such blocks. For instance, some acts or events may occur in different orders and/or concurrently with other acts or events, apart from the ordering illustrated herein, in accordance with the invention. Moreover, not all illustrated blocks, events, or acts, may be required to implement a methodology in accordance with the present invention. In addition, it will be appreciated that the exemplary method 302 and other methods according to the invention may be implemented in association with the pumps and systems illustrated and described herein, as well as in association with other systems and apparatus not illustrated or described.

Beginning at 304, pump flow and pressure sensor data are read at 306. For example, readings may be taken at 306 from flow and pressure sensors operatively associated with the pump so as to sense at least one flow and at least one pressure, respectively, associated with the pumping system. More than one pressure reading may be obtained at 306, such as by measuring suction pressure data and discharge pressure data associated with an inlet and an outlet, respectively, of the pumping system. In this regard, it will be appreciated that other sensor values associated with a pumping system may be measured at 306, such as pump speed. In this manner, the cavitation may be detected and/or diagnosed at various speeds.

Thereafter at 308, the measured pumping system parameters (e.g., pressures, flow, speed, etc.) are provided to a classifier system, such as a neural network. For instance, the flow and pressure data (e.g., and pump speed data) may be provided as inputs to a neural network, wherein the neural network may be trained using back propagation of other learning techniques (e.g., reinforcement learning, unsupervised learning) in either on-line or off-line learning. The neural network of the classifier system, moreover, may be trained using one or more learning rules or laws, including but not limited to Hebb's Rule, Hopfield Law, the Delta Rule, and/or Kohonen's Law. At 310, a cavitation signal is provided by the classifier, which is indicative of cavitation in the pumping system, whereafter the method 302 returns to again measure and process flow and pressure data at 306–310 as described above.

It will be appreciated that the classifier may further diagnose the extent of pump cavitation according to the flow and pressure data. In this regard, the detection of pump cavitation at 310 according to the flow and pressure data may comprise providing a cavitation signal from the classifier system indicative of the existence and extent of pump cavitation. The method 302 may further comprise changing the operation of the pump according to the cavitation signal, such as where the cavitation signal is provided to a controller associated with the pumping system. In this manner pump cavitation and the adverse effects may be avoided or reduced in accordance with the invention. In order to ascertain the extent of pump cavitation, the cavitation signal or other output from the neural network of the classifier system, may comprise a classification of pump cavitation having one of a plurality of class values, wherein each of the plurality of class values is indicative of the extent of cavitation in the pumping system, and wherein at least one of the plurality of class values is indicative of no cavitation in the pumping system.

Although the invention has been shown and described with respect to certain illustrated aspects, it will be appreciated that equivalent alterations and modifications will occur to others skilled in the art upon the reading and understanding of this specification and the annexed drawings. In particular regard to the various functions performed by the above described components (assemblies, devices, circuits, systems, etc.), the terms (including a reference to a "means") used to describe such components are intended to correspond, unless otherwise indicated, to any component which performs the specified function of the described component (e.g., that is functionally equivalent), even though not structurally equivalent to the disclosed structure, which performs the function in the herein illustrated exemplary aspects of the invention. In this regard, it will also be recognized that the invention includes a system as well as a computer-readable medium having computer-executable instructions for performing the acts and/or events of the various methods of the invention.

In addition, while a particular feature of the invention may have been disclosed with respect to only one of several implementations, such feature may be combined with one or more other features of the other implementations as may be desired and advantageous for any given or particular application. As used in this application, the term "component" is intended to refer to a computer-related entity, either hardware, a combination of hardware and software, software, or software in execution. For example, a component may be, but is not limited to, a process running on a processor, a processor, an object, an executable, a thread of execution, a program, and a computer. Furthermore, to the extent that the terms "includes", "including", "has", "having", and variants thereof are used in either the detailed description or the claims, these terms are intended to be inclusive in a manner similar to the term "comprising."

What is claimed is:

1. A system for detecting cavitation in a motorized pumping system, comprising:

a measuring system adapted to measure pump flow and pressure data associated with the pumping system; and an adaptive classifier system adapted to detect pump cavitation existence and extent according to the flow and pressure data.

2. The system of claim 1, wherein the classifier system comprises a neural network.

3. The system of claim 2, wherein the neural network is trained using back propagation.

4. The system of claim 1, wherein the measuring system comprises sensors for measuring suction pressure data and discharge pressure data associated with an inlet and an outlet, respectively, of the pumping system.

5. The system of claim 1, further comprising a speed sensor for measuring pump speed, wherein the classifier system is adapted to detect pump cavitation according to the flow, pressure, and speed data.

6. The system of claim 2, wherein the neural network is adapted to provide a cavitation signal indicative of the existence and extent of cavitation in the pumping system, further comprising a system adapted to change the operation of the pumping system according to the cavitation signal.

7. A system for detecting cavitation in a motorized pumping system, comprising: an adaptive classifier system adapted to detect pump cavitation existence and extent according to flow and pressure data.

8. The system of claim 7, wherein the classifier system comprises a neural network receiving flow and pressure signals from flow and pressure sensors associated with the pumping system.

9. The system of claim 8, wherein the neural network is trained using back propagation.

10. The system of claim 9, wherein the neural network receives suction pressure data and discharge pressure data from suction and discharge pressure sensors associated with an inlet and an outlet, respectively, of the pumping system.

11. The system of claim 10, wherein the neural network further receives pump speed data from a speed sensor associated with the pumping system and wherein the neural network is adapted to detect pump cavitation according to the flow, pressure, and speed data.

12. The system of claim 11, wherein the neural network is adapted to provide a cavitation signal indicative of the existence and extent of cavitation in the pumping system.

13. The system of claim 11, further comprising means for changing the operation of the pumping system according to the cavitation signal.

14. A method of detecting cavitation in a pumping system having a motorized pump, comprising:

measuring pump flow and pressure data;

providing the flow and pressure data to an adaptive classifier system; and detecting pump cavitation existence and extent according to the flow and pressure data using the classifier system.

15. The method of claim 14, wherein providing the flow and pressure data to a classifier system comprises providing flow and pressure data as inputs to a neural network.

16. The method of claim 15, wherein measuring pump flow and pressure data comprises reading flow and pressure sensors operatively associated with the pump so as to sense at least one flow and at least one pressure, respectively, associated with the pumping system.

17. The method of claim 16, wherein measuring pump pressure data comprises reading suction pressure data and discharge pressure data associated with an inlet and an outlet, respectively, of the pumping system.

18. The method of claim 17, further comprising teaching the classifier system.

19. The method of claim 18, further comprising:

measuring pump speed data;

providing the speed data to the classifier system; and detecting pump cavitation existence and extent according to the flow, pressure, and speed data using the classifier system.

20. The method of claim 19, wherein detecting pump cavitation according to the flow, pressure, and speed data using the classifier system comprises providing a cavitation signal from the classifier system to the pumping system.

21. The method of claim 20, further comprising changing the operation of the pump according to the cavitation signal.

22. The method of claim 14, wherein detecting pump cavitation according to the flow, pressure using the classifier system comprises providing a cavitation signal from the classifier system to the pumping system.

23. The method of claim 22, further comprising changing the operation of the pump according to the cavitation signal.

24. The method of claim 22, wherein providing the flow and pressure data to a classifier system comprises providing flow and pressure data as inputs to a neural network, and wherein detecting pump cavitation according to the flow and pressure data comprises providing a cavitation signal from the classifier system indicative of the existence and extent of pump cavitation.

25. The method of claim 24, further comprising:

measuring pump speed data;

providing the speed data to the classifier system; and detecting pump cavitation according to the flow, pressure, and speed data using the classifier system.

26. The method of claim 24, further comprising changing the operation of the pump according to the cavitation signal.

27. The method of claim 15, wherein detecting pump cavitation according to the flow and pressure data using the classifier system comprises providing a cavitation signal from the classifier system to the pumping system.

28. The method of claim 27, further comprising changing the operation of the pump according to the cavitation signal.

29. The method of claim 15, further comprising:

measuring pump speed data;

providing the speed data to the classifier system; and detecting pump cavitation existence and extent according to the flow, pressure, and speed data using the classifier system.

30. The method of claim 14, further comprising diagnosing the extent of pump cavitation according to the flow and pressure data using the classifier system.

31. The method of claim 30, wherein detecting pump cavitation according to the flow, pressure, and speed data using the classifier system comprises providing a cavitation signal from the classifier system to the pumping system.

32. The method of claim 31, further comprising changing the operation of the pump according to the cavitation signal.

33. The method of claim 32, further comprising:

measuring pump speed data;

providing the speed data to the classifier system; and detecting pump cavitation existence and extent according to the flow, pressure, and speed data using the classifier system.

34. The method of claim 31, wherein the cavitation signal comprises a classification of pump cavitation having one of a plurality of class values, wherein each of the plurality of class values is indicative of the extent of cavitation in the pumping system, and wherein at least one of the plurality of class values is indicative of no cavitation in the pumping system.

* * * * *